US012173377B2

(12) United States Patent
Takeda et al.

(10) Patent No.: US 12,173,377 B2
(45) Date of Patent: Dec. 24, 2024

(54) GRAIN-ORIENTED ELECTRICAL STEEL SHEET AND METHOD FOR MANUFACTURING SAME

(71) Applicant: NIPPON STEEL CORPORATION, Tokyo (JP)

(72) Inventors: Kazutoshi Takeda, Tokyo (JP); Ichiro Tanaka, Tokyo (JP); Tomoya Suenaga, Tokyo (JP); Takashi Kataoka, Tokyo (JP); Yuki Kunita, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 664 days.

(21) Appl. No.: 17/421,845

(22) PCT Filed: Jan. 16, 2020

(86) PCT No.: PCT/JP2020/001157
§ 371 (c)(1),
(2) Date: Jul. 9, 2021

(87) PCT Pub. No.: WO2020/149329
PCT Pub. Date: Jul. 23, 2020

(65) Prior Publication Data

US 2022/0098692 A1 Mar. 31, 2022

(30) Foreign Application Priority Data

Jan. 16, 2019 (JP) ..... 2019-005239

(51) Int. Cl.
*C21D 9/46* (2006.01)
*C21D 8/12* (2006.01)
(Continued)

(52) U.S. Cl.
CPC ..... *C21D 9/46* (2013.01); *C21D 8/1222* (2013.01); *C21D 8/1233* (2013.01);
(Continued)

(58) Field of Classification Search
CPC ..... C21D 8/0284; C21D 8/0289
See application file for complete search history.

(56) References Cited

U.S. PATENT DOCUMENTS 3,856,568 A 12/1974 Tanaka et al.
3,932,236 A 1/1976 Wada et al.
(Continued)

FOREIGN PATENT DOCUMENTS

CN 108474054 A 8/2018
JP 48-39338 A 6/1973
(Continued)

*Primary Examiner* — Nicholas A Wang
(74) *Attorney, Agent, or Firm* — Birch, Stewart, Kolasch & Birch, LLP

(57) ABSTRACT

The grain-oriented electrical steel sheet is a grain-oriented electrical steel sheet which does not have an inorganic coating containing forsterite as a main component, including a base steel sheet having a predetermined chemical component, a silicon-containing oxide layer provided on the base steel sheet, an iron-based oxide layer provided on the silicon-containing oxide layer, and a tension-insulation coating provided on the iron-based oxide layer, having a thickness of 1 to 3 μm, and containing phosphate and colloidal silica as main components. When elemental analysis is performed from a surface of the tension-insulation coating in a sheet thickness direction by glow discharge optical emission spectrometry, predetermined requirements are satisfied.

9 Claims, 3 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/60*** | (2006.01) |
| ***C23C 22/18*** | (2006.01) |
| ***C23C 22/20*** | (2006.01) |
| ***C23C 22/74*** | (2006.01) |
| ***C23C 28/04*** | (2006.01) |
| ***C23G 1/08*** | (2006.01) |

(52) U.S. Cl.

CPC ..... *C21D 8/1272* (2013.01); *C21D 8/1283* (2013.01); *C22C 38/001* (2013.01); *C22C 38/002* (2013.01); *C22C 38/02* (2013.01); *C22C 38/04* (2013.01); *C22C 38/06* (2013.01); *C22C 38/60* (2013.01); *C23C 22/18* (2013.01); *C23C 22/20* (2013.01); *C23C 22/74* (2013.01); *C23C 28/04* (2013.01); *C23G 1/081* (2013.01); *C23G 1/083* (2013.01); *C23G 1/085* (2013.01); *C21D 2201/05* (2013.01)

(56) References Cited

U.S. PATENT DOCUMENTS

| | | | |
|---|---|---|---|
| 6,287,703 | B1 | 9/2001 | Inokuti |
| 2018/0119244 | A1 | 5/2018 | Omura et al. |
| 2018/0237876 | A1 | 8/2018 | Hecht et al. |
| 2019/0010572 | A1 | 1/2019 | Han et al. |

FOREIGN PATENT DOCUMENTS

| | | | | |
|---|---|---|---|---|
| JP | 49-96920 | A | | 9/1974 |
| JP | 58-26405 | B2 | | 6/1983 |
| JP | 0577124 | | * | 1/1994 |
| JP | 7-54155 | A | | 2/1995 |
| JP | 4041289 | B2 | | 1/2008 |
| JP | 4300604 | B2 | | 7/2009 |
| KR | 10-2017-0106401 | A | | 9/2017 |

* cited by examiner

GRAIN-ORIENTED ELECTRICAL STEEL SHEET AND METHOD FOR MANUFACTURING SAME

TECHNICAL FIELD

The present invention relates to a grain-oriented electrical steel sheet and a method for manufacturing the same.

Priority is claimed on Japanese Patent Application No. 2019-5239, filed Jan. 16, 2019, the content of which is incorporated herein by reference.

BACKGROUND ART

Generally, grain-oriented electrical steel sheets are utilized as iron cores for transformers or the like and the magnetic characteristics of the grain-oriented electrical steel sheets have a significant influence on the performance of transformers. Thus, various research and development has been conducted to improve the magnetic characteristics. As a means for reducing the iron loss of grain-oriented electrical steel sheets, for example, Patent Document 1 below describes a technique for forming a tension application coating by application a solution containing colloidal silica and phosphate as main components to a surface of steel sheet which has been subjected to final annealing and firing these to reduce the iron loss. Furthermore, Patent Document 2 below describes a technique for irradiating a surface of a material which has been subjected to final annealing with a laser beam to apply local strain to a steel sheet to subdivide magnetic domains and reduce iron loss. With these techniques, the iron loss of grain-oriented electrical steel sheets has become extremely good.

Incidentally, in recent years, there has been an increasing demand for reducing the size and increasing the performance of transformers. In addition, in order to reduce the size of transformers, grain-oriented electrical steel sheets are required to be excellent in terms of having a high magnetic field iron loss so that excellent iron loss is provided even when a high magnetic flux density is provided. As a means for improving this high magnetic field iron loss, research regarding eliminating an inorganic coating existing on an ordinary grain-oriented electrical steel sheet to apply more tension has been conducted. Since the tension application coating is formed later, the inorganic coating may be referred to as a "primary coating" and a tension application coating may be referred to as a "secondary coating" is some cases.

Inorganic coatings containing forsterite ($Mg_2SiO_4$) as a main component are generated on surfaces of grain-oriented electrical steel sheets by reacting oxide layers containing silica ($SiO_2$) generated using a decarburization annealing process as a main component with magnesium oxides applied to a surface to prevent baking during final annealing. Inorganic coatings have a slight tension effect and have the effect of improving the iron loss of grain-oriented electrical steel sheets. However, as a result of the research so far, it has become clear since the inorganic coatings are non-magnetic layers, they adversely affect the magnetic characteristics (particularly, high magnetic field iron loss characteristics). Therefore, research regarding techniques for manufacturing grain-oriented electrical steel sheets in which inorganic coatings are not provided or techniques for making the surfaces of steel sheets have mirror surfaces (techniques for magnetically smoothing surfaces of steel sheets) by removing the inorganic coatings using mechanical means such as polishing or chemical means such as pickling or preventing the formation of inorganic coatings during high-temperature final annealing is being conducted.

As techniques for preventing the formation of such inorganic coatings or smoothing the surfaces of the steel sheets, for example, Patent Document 3 below describes a technique for subjecting a surface of a steel sheet to ordinary final annealing, pickling to remove surface formations and then making the surface of the steel sheet have a mirror surface through chemical polishing or electrolytic polishing. In recent years, for example, a technique or the like as described in Patent Document 4 below for preventing the formation of an inorganic coating by incorporating bismuth (Bi) or a bismuth compound in an annealing separator used at the time of final annealing has been disclosed. It has been found that a superior iron loss improving effect can be obtained by forming tension application coatings on the surfaces of the grain-oriented electrical steel sheets which are obtained through these known methods, and in which inorganic coatings are not provided or which have excellent magnetic smoothness.

However, the inorganic coatings need to have the effect of exhibiting insulating properties, serve as intermediate layers configured to secure adhesion when tension-insulation coatings are applied, and serve as intermediate layers of inorganic coatings when tension-application secondary coatings are formed on grain-oriented electrical steel sheets in which inorganic coatings are not provided.

That is to say, although an inorganic coating is formed on a surface of a steel sheet which has been subjected to final annealing when a grain-oriented electrical steel sheet is manufactured through an ordinary manufacturing process, such an inorganic coating is formed in a state of deeply entering the steel sheet. Thus, the inorganic coating has good adhesion to the steel sheet made of a metal. For this reason, it is possible to form a tension-insulation coating containing colloidal silica, phosphate, and the like as a main component on a surface of an inorganic coating. Incidentally, in general, a metal does not easily bond to oxides. Thus, when there is no inorganic coating, sufficient adhesion is not easily secured between a tension-insulation coating and a surface of an electrical steel sheet.

As a method for improving the adhesion between a steel sheet and a tension-insulation coating as described above, for example, Patent Document 5 below describes a technique for forming an iron-based oxide by annealing a grain-oriented electrical steel sheet which does not include an inorganic coating in an acidic atmosphere, forming a $SiO_2$ coating on a surface of a steel sheet by further annealing the grain-oriented electrical steel sheet in a weakly reducing atmosphere, and then forming a tension-insulation coating.

Also, as a method for improving iron loss in a grain-oriented electrical steel sheet which does not have an inorganic coating, for example, Patent Document 6 below describes a technique for forming a nitride/oxide layer which contains Si as an under-coating of a tension-insulation coating by attaching Si in an active state to a surface of the grain-oriented electrical steel sheet which does not have an inorganic coating and then forming the tension-insulation coating.

CITATION LIST

Patent Document

[Patent Document 1]
Japanese Unexamined Patent Application, First Publication No. S48-39338
[Patent Document 2]
Japanese Examined Patent Application, Second Publication No. S58-26405
[Patent Document 3]
Japanese Unexamined Patent Application, First Publication No. S49-96920
[Patent Document 4]
Japanese Unexamined Patent Application, First Publication No. H7-54155
[Patent Document 5]
Japanese Patent No. 4041289
[Patent Document 6]
Japanese Patent No. 4300604

SUMMARY OF THE INVENTION

Problems to be Solved by the Invention

However, even when the techniques disclosed in Patent Document 5 and Patent Document 6 above are used, there is a room for improvement in adhesion and iron loss in a grain-oriented electrical steel sheet which does not have an inorganic coating.

Therefore, the present invention has been made in view of the above problems, and an object of the present invention is to provide a grain-oriented electrical steel sheet for which adhesion of a tension-insulation coating can be improved in a stable manner and excellent magnetic characteristics can be realized even in the case of a grain-oriented electrical steel sheet having no inorganic coating, and a method for manufacturing the same.

Means for Solving the Problem

In order to achieve the above object, the inventors conducted extensive studies, and as a result, found that, after a pickling treatment using a specific acid and a heat treatment are performed on a grain-oriented electrical steel sheet having no inorganic coating containing forsterite as a main component, a tension-insulation coating is formed under specific conditions, and thus an iron-based oxide layer and a silicon-containing oxide layer in a specific state are formed between the tension-insulation coating and a base steel sheet, and it is possible to stably improve the adhesion of the tension-insulation coating and realize excellent magnetic characteristics.

The scope of the present invention completed based on the above findings is as follows.

[1] A grain-oriented electrical steel sheet according to an aspect of the present invention is a grain-oriented electrical steel sheet which does not have an inorganic coating containing forsterite as a main component, including:

a base steel sheet;

a silicon-containing oxide layer provided on the base steel sheet;

an iron-based oxide layer provided on the silicon-containing oxide layer; and a tension-insulation coating provided on the iron-based oxide layer, having a thickness of 1 to 3 μm and containing phosphate and colloidal silica as main components;

wherein the base steel sheet contains, as chemical components, in terms of, 2.5 to 4.5% of Si, 0.05 to 1.00% of Mn, 0% or more and less than 0.05% of Al, 0% or more and less than 0.1% of C, 0% or more and less than 0.05% of N, 0% or more and less than 0.1% of S, 0% or more and less than 0.05% of Se and 0% or more and less than 0.01% of Bi, and the remainder: Fe and impurities, wherein, when elemental analysis is performed from a surface of the tension-insulation coating in a sheet thickness direction by glow discharge optical emission spectrometry, (a) in a profile of a Si light emission intensity, there are four or more inflection points;

(b) in the sheet thickness direction, the inflection point of the Si light emission intensity present closest to the base steel sheet side is present within a range of 0.3 to 1.5 μm toward the side of the surface of the tension-insulation coating from a saturation point at which an Fe light emission intensity is a maximum, and (c) a peak of the Si light emission intensity present closest to the base steel sheet side has a light emission intensity that is 1.3 times or more and 2.0 times or less the Si light emission intensity in the base steel sheet.

[2] The grain-oriented electrical steel sheet according to [1], wherein the silicon-containing oxide layer may contain silica and fayalite as main components, and wherein the tension-insulation coating may contain 25 to 45 mass % of colloidal silica, with a remainder that contains one or more selected from the group consisting of aluminum phosphate, magnesium phosphate, zinc phosphate, manganese phosphate, cobalt phosphate, and iron phosphate as main components.

[3] The grain-oriented electrical steel sheet according to [1] or [2], wherein the iron-based oxide layer may contain magnetite, hematite and fayalite as main components.

[4] The grain-oriented electrical steel sheet according to any one of [1] to [3], wherein a thickness of the base steel sheet may be 0.27 mm or less.

[5] A method for manufacturing a grain-oriented electrical steel sheet according to another aspect of the present invention is a method for manufacturing a grain-oriented electrical steel sheet which includes a base steel sheet and a tension-insulation coating and does not have an inorganic coating containing forsterite as a main component, including:

a washing process of cleaning a surface of the grain-oriented electrical steel sheet;

a surface treatment process of treating the surface of the grain-oriented electrical steel sheet which has been subjected to the washing process using a surface treatment liquid which contains one or more of sulfuric acid, phosphoric acid and nitric acid and having a total acid concentration of 2 to 20% and a liquid temperature of 70 to 90° C.;

a heating treatment process of heating the grain-oriented electrical steel sheet which has been subjected to the surface treatment process at a temperature of 700 to 900° C. for 10 to 60 seconds in an atmosphere having an oxygen concentration of 1 to 21 volume % and a dew point of −20 to 30° C.; and a tension-insulation coating forming process of forming a tension-insulation coating which has a thickness of 1 to 3 μm by applying a treatment solution for forming a tension-insulation coating containing phosphate and colloidal silica as main components to the surface of the grain-oriented electrical steel sheet after the heating treatment process, and heating is performed at an average heating rate of 20 to 100°

C./s within 1.0 to 20 seconds after the application, and baking is performed at a temperature of 850 to 950° C. for 10 to 60 seconds.

[6] The method for manufacturing an insulation coating of a grain-oriented electrical steel sheet according to [5], may further include:

before the washing process, a hot rolling process of subjecting a steel piece which contains, as chemical components, in terms of mass %, 2.5 to 4.5% of Si, 0.05 to 1.00% of Mn, less than 0.05% of Al, less than 0.1% of C, less than 0.05% of N, less than 0.1% of S, less than 0.05% of Se and less than 0.01% of Bi with the remainder being Fe and impurities to hot rolling;

an optional annealing process;

a cold rolling process of performing one cold rolling or two or more cold rollings having intermediate annealing performed between the cold rollings;

a decarburization annealing process; and a final annealing process of applying an annealing separator obtained by incorporating bismuth chloride into a mixture of MgO and $Al_2O_3$ or an annealing separator obtained by incorporating a bismuth compound and a metallic chloride compound into a mixture of MgO and $Al_2O_3$, drying the annealing separator, and then performing final annealing.

Effects of the Invention

As described above, according to the present invention, even in a grain-oriented electrical steel sheet having no inorganic coating containing forsterite as a main component, it is possible to stably improve the adhesion of the tension-insulation coating and realize excellent magnetic characteristics.

EMBODIMENT(S) FOR IMPLEMENTING THE INVENTION

Figure 1:
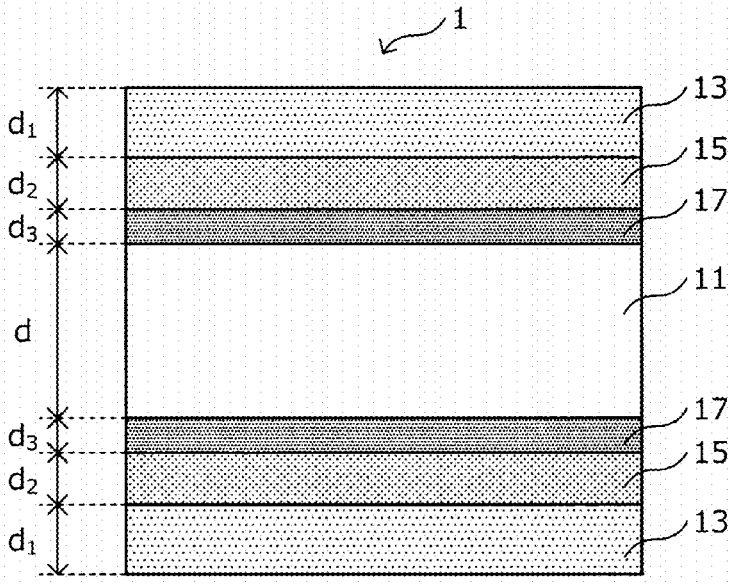
FIG. 1 is an explanatory diagram schematically showing an example of a structure of a grain-oriented electrical steel sheet according to an embodiment of the present invention.

Preferable embodiments of the present invention will be described below in detail with reference to the attached figures. Here, in this specification and drawings, components having substantially the same functional configuration will be denoted with the same reference numerals and redundant descriptions thereof will be omitted.

(Regarding Grain-Oriented Electrical Steel Sheet)

Figure 2:
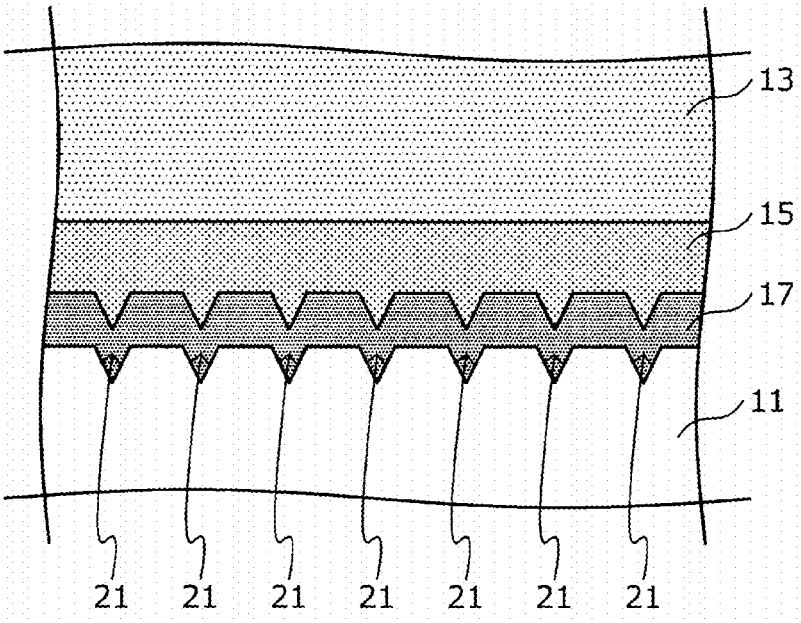
FIG. 2 is an explanatory diagram for explaining the grain-oriented electrical steel sheet according to the same embodiment.

First, a grain-oriented electrical steel sheet according to an embodiment of the present invention will be described in detail with reference to FIG. 1 and FIG. 2. FIG. 1 is an explanatory diagram schematically showing an example of a structure of the grain-oriented electrical steel sheet according to the present embodiment. FIG. 2 is an explanatory diagram for explaining the grain-oriented electrical steel sheet according to the present embodiment.

The inventors found that, (1) for example, for a high magnetic field iron loss such as at 1.7 T to 1.9 T, when an inorganic coating containing forsterite ($Mg_2SiO_4$) or the like is removed, the iron loss is significantly reduced, and (2) in order to form a tension-insulation coating that exhibits a high tension of 1.0 kgf/mm$^2$ or more on the surface of a steel sheet having no inorganic coating with favorable adhesion, it is necessary to form a silicon-containing oxide layer and an iron-based oxide layer on the surface of the steel sheet in this order, and when the silicon-containing oxide layer and the iron-based oxide layer are formed, the adhesion of the tension-insulation coating and the high magnetic field iron loss are improved. Based on the above findings, the inventors completed the grain-oriented electrical steel sheet according to the present embodiment.

A grain-oriented electrical steel sheet 1 according to the present embodiment is a grain-oriented electrical steel sheet which does not have an inorganic coating containing forsterite as a main component, and as schematically shown in FIG. 1, includes a base steel sheet 11;

a silicon-containing oxide layer 17 provided on the base steel sheet;

an iron-based oxide layer 15 provided on the silicon-containing oxide layer; and a tension-insulation coating 13 provided on the iron-based oxide layer, having a thickness of 1 to 3 μm and containing phosphate and colloidal silica as main components. As schematically shown in FIG. 1, the silicon-containing oxide layer 17, the iron-based oxide layer 15 and the tension-insulation coating 13 are provided on both surfaces of the base steel sheet 11. Here, although FIG. 1 shows a case in which the silicon-containing oxide layer 17, the iron-based oxide layer 15 and the tension-insulation coating 13 are provided on both surfaces of the base steel sheet 11, the silicon-containing oxide layer 17, the iron-based oxide layer 15 and the tension-insulation coating 13 may be provided only on one surface of the base steel sheet 11.

Hereinafter, the base steel sheet 11, the tension-insulation coating 13 (hereinafter simply abbreviated as "insulation coating" in some cases), the iron-based oxide layer 15 and the silicon-containing oxide layer 17 of the grain-oriented electrical steel sheet 1 according to the present embodiment will be described in detail.

<Regarding Base Steel Sheet 11>

Generally, a grain-oriented electrical steel sheet contains silicon (Si) as a chemical component, but silicon is very easily oxidized, an oxidized coating containing silicon (more specifically, an oxidized coating containing silica as a main component) is formed on the surface of a steel sheet after decarburization annealing. An annealing separator is applied to the surface of the steel sheet after decarburization annealing, and the steel sheet is then wound into a coil, and final annealing is performed. In a general method of producing a grain-oriented electrical steel sheet, when an annealing separator containing MgO as a main component is used, MgO reacts with the oxidized coating on the surface of the steel sheet during final annealing and an inorganic coating containing forsterite ($Mg_2SiO_4$) as a main component is formed. However, in the grain-oriented electrical steel sheet 1 according to the present embodiment, a grain-oriented electrical steel sheet having no inorganic coating containing forsterite as a main component on its surface is used as the base steel sheet 11 instead of the above grain-oriented electrical steel sheet having an inorganic coating containing forsterite as a main component on its surface.

Here, a method for manufacturing a grain-oriented electrical steel sheet having no inorganic coating containing forsterite as a main component on its surface will be described below again.

In the grain-oriented electrical steel sheet 1 according to the present embodiment, the grain-oriented electrical steel sheet used as the base steel sheet 11 is not particularly limited, and a grain-oriented electrical steel sheet containing known chemical components can be used. Examples of such a grain-oriented electrical steel sheet include a grain-oriented electrical steel sheet containing, as chemical components, by mass %, 2.5 to 4.5% of Si, 0.05 to 1.00% of Mn, 0% or more and less than 0.05% of Al, 0% or more and less than 0.1% of C, 0% or more and less than 0.05% of N, 0% or more and less than 0.1% of S, 0% or more and less than 0.05% of Se, and 0% or more and less than 0.01% of Bi with the remainder being Fe and impurities.

When the Si content in the base steel sheet is 2.5 mass % or more, desired magnetic characteristics can be obtained. On the other hand, when the Si content in the base steel sheet is more than 4.5 mass %, since the steel sheet becomes brittle, production becomes difficult. Therefore, the Si content in the base steel sheet is 4.5 mass % or less.

When the Mn content in the base steel sheet is 0.05 mass % or more, it is possible to secure the absolute amount of MnS, which is an inhibitor required for causing secondary recrystallization. On the other hand, when the Mn content in the base steel sheet exceeds 1.00 mass %, steel undergoes phase transformation during secondary recrystallization annealing, secondary recrystallization does not proceed sufficiently, and it is not possible to obtain favorable magnetic flux density and iron loss characteristics. Therefore, the Mn content in the base steel sheet is 1.00 mass % or less.

The base steel sheet may contain, as chemical components, less than 0.005 mass % of each of Al, C, N, S, Se and Bi in addition to Si and Mn. Since these elements do not have to be contained, the lower limit value is 0 mass %.

When the Al content in the base steel sheet is more than 0 mass % and less than 0.05 mass %, it is possible to minimize embrittlement of the steel sheet and improve iron loss characteristics.

When the C content in the base steel sheet is more than 0 mass % and less than 0.1 mass %, it is possible to realize favorable magnetic flux density and iron loss characteristics.

When the N content in the base steel sheet is more than 0 mass % and less than 0.05 mass %, it is possible to minimize the decrease in passability during production.

When the S content in the base steel sheet is more than 0 mass % and 0.1 mass % or less, it is possible to minimize embrittlement of the steel sheet.

When the Se content in the base steel sheet is 0 mass % or more and 0.05 mass % or less, it is possible to realize a magnetic improvement effect.

When the Bi content in the base steel sheet is 0 mass % or more and 0.01 mass % or less, it is possible to realize favorable magnetic flux density and iron loss characteristics.

As schematically shown in FIG. 2, a microstructure 21 also called an etch pit is provided on the surface of the base steel sheet 11 according to the present embodiment. In a method of producing a grain-oriented electrical steel sheet according to the present embodiment to be described below in detail, the microstructure 21 is formed when a surface treatment liquid using a specific acid is applied to the surface of a grain-oriented electrical steel sheet having no inorganic coating and subjected to final annealing. When the microstructure 21 schematically shown in FIG. 2 is provided on the surface of the base steel sheet 11, the silicon-containing oxide layer 17 and the iron-based oxide layer 15 formed on the surface of the base steel sheet 11 further improve adhesion to the base steel sheet 11 due to a so-called anchor effect.

<Regarding Tension-Insulation Coating 13>

The tension-insulation coating 13 is provided on the surface of the grain-oriented electrical steel sheet 1 according to the present embodiment. The tension-insulation coating 13 imparts electrical insulation to the grain-oriented electrical steel sheet, and thus an eddy current loss is reduced, and the iron loss of the grain-oriented electrical steel sheet is reduced. In addition, the tension-insulation coating 13 exhibits various characteristics such as corrosion resistance, heat resistance, and slipperiness in addition to the above electrical insulation.

In addition, the tension-insulation coating 13 has a function of application a tension to the grain-oriented electrical steel sheet. The tension-insulation coating applies a tension to the grain-oriented electrical steel sheet, facilitates domain wall motion in the grain-oriented electrical steel sheet, and thus can reduce the iron loss of the grain-oriented electrical steel sheet.

The tension-insulation coating 13 is a tension-insulation coating of a phosphate silica mixed system containing phosphate and colloidal silica as main components. The tension-insulation coating of such a phosphate silica mixed system contains, for example, 25 to 45 mass % of colloidal silica, with the remainder that preferably contains one or more selected from the group consisting of aluminum phosphate, magnesium phosphate, zinc phosphate, manganese phosphate, cobalt phosphate, and iron phosphate as main components.

The thickness of the tension-insulation coating 13 (thickness $d_1$ in FIG. 1) of the phosphate silica mixed system is in a range of 1 to 3 μm. When the thickness of the tension-insulation coating 13 is less than 1 μm, it is not possible to sufficiently improve various characteristics such as electrical insulation, corrosion resistance, heat resistance, slipperiness, and tension application properties as described above. On the other hand, when the thickness of the tension-insulation coating 13 exceeds 3 μm, this is not preferable because the space factor of the base steel sheet 11 decreases. When the thickness of the tension-insulation coating 13 is within a range of 1 to 3 μm, it is possible to realize a high tension of 1.0 $kgf/mm^2$ or more. The thickness $d_1$ of the tension-insulation coating 13 is preferably within a range of 2.5 to 3.0 μm.

<Regarding Iron-Based Oxide Layer 15>

The iron-based oxide layer 15 functions as an intermediate layer between the base steel sheet 11 and the tension-insulation coating 13 together with the silicon-containing oxide layer 17 to be described below in the grain-oriented electrical steel sheet 1 according to the present embodiment. The iron-based oxide layer 15 contains, for example, an iron-based oxide such as magnetite ($Fe_3O_4$), hematite ($Fe_2O_3$), or fayalite ($Fe_2SiO_4$) as a main component.

Since the iron-based oxide, which is the main component of the iron-based oxide layer 15, is formed when the surface of the base steel sheet 11 reacts with oxygen, the adhesion between the iron-based oxide layer 15 and the base steel sheet 11 is favorable. In addition, as described above, as schematically shown in FIG. 2, the microstructure 21 also called an etch pit is provided on the surface of the base steel sheet 11. Therefore, the iron-based oxide layer 15 formed on the microstructure 21 can further improve the adhesion to the base steel sheet 11 due to a so-called anchor effect together with the silicon-containing oxide layer 17 to be described below.

Generally, it is often difficult to improve the adhesion between a metal and a ceramic. On the other hand, in the grain-oriented electrical steel sheet 1 according to the present embodiment, since the iron-based oxide layer 15 is provided between the base steel sheet 11 and the tension-insulation coating 13 which is a type of ceramic, it is possible to improve the adhesion of the tension-insulation coating 13 even if the inorganic coating is not formed on the surface of the base steel sheet 11.

In the grain-oriented electrical steel sheet 1 according to the present embodiment, the thickness (thickness $d_2$ in FIG. 1) of the iron-based oxide layer 15 is preferably within a range of 100 to 500 nm. When the thickness $d_2$ of the iron-based oxide layer 15 is less than 100 nm, the iron-based oxide layer 15 and the silicon-containing oxide layer 17 may be dissolved due to an acidic treatment solution used when the tension-insulation coating 13 is formed, and there is a high possibility of sufficient adhesion not being obtained. On the other hand, when the thickness $d_2$ of the iron-based oxide layer 15 exceeds 500 nm, the iron-based oxide layer 15 becomes too thick, and a possibility of partial peeling increases. In the grain-oriented electrical steel sheet 1 according to the present embodiment, the thickness $d_2$ of the iron-based oxide layer 15 is preferably in a range of 150 to 400 nm, and more preferably in a range of 170 to 250 nm.

The thickness $d_2$ of the iron-based oxide layer 15 can be determined by observing a distribution of iron-oxygen bonds on the cross section of the grain-oriented electrical steel sheet 1 according to the present embodiment, using, for example, using X-ray photoelectron spectroscopy (XPS). That is, in XPS, focusing on the intensity of Fe—O peaks appearing at 712 eV and the intensity of metal Fe peaks appearing at 708 eV, sputtering is performed from the side of the surface of the grain-oriented electrical steel sheet 1 from which the tension-insulation coating 13 is removed toward the base steel sheet 11, a distance from the outermost layer where the measurement starts to the position in the depth direction at which the intensity of Fe—O peaks appearing at 712 eV and the intensity of metal Fe peaks appearing at 708 eV are interchanged can be used as the thickness of the iron-based oxide layer 15.

The main component of the iron-based oxide layer 15 can be determined by performing an X-ray crystal structure analysis method or XPS analysis. Based on the measurement results so far, the inventors found that the iron-based oxide layer 15 mainly contains an iron-based oxide as a main component and a small amount of silica.

<Regarding Silicon-Containing Oxide Layer 17>

The silicon-containing oxide layer 17 is a layer functioning as an intermediate layer between the base steel sheet 11 and the tension-insulation coating 13 together with the above iron-based oxide layer 15 in the grain-oriented electrical steel sheet 1 according to the present embodiment. The silicon-containing oxide layer 17 contains silica and fayalite ($Fe_2SiO_4$) as main components.

As will be described below, when the surface of the grain-oriented electrical steel sheet having no inorganic coating is treated using a treatment solution containing at least one of sulfuric acid, nitric acid and phosphoric acid, the microstructure 21 also called an etch pit as shown in FIG. 2 is formed on the surface of the base steel sheet 11, and the adhesion of the tension-insulation coating 13 is secured. Here, the inventors conducted verification in more detail on the adhesion of the tension-insulation coating in the grain-oriented electrical steel sheet in which the microstructure is formed on the surface of the base steel sheet, and found that there are some parts with favorable adhesion and some parts with poor adhesion under certain production conditions.

As a result of verifying the above phenomenon, it is found that, in parts with favorable adhesion, a silicon-containing oxide layer containing silica derived from Si diffused from the base steel sheet and fayalite ($Fe_2SiO_4$) as main components is formed on the side of a layer (the side of the base steel sheet) below the iron-based oxide layer, but there is no iron-based oxide layer or silicon-containing oxide layer in parts with poor adhesion. One reason for a part in which there is no iron-based oxide layer or silicon-containing oxide layer is generated is considered to be that the abundance of the iron-based oxide layer and the silicon-containing oxide layer is small (in other words, the thickness is thin). It is speculated that, since the treatment solution used for forming a tension-insulation coating is acidic, the thin iron-based oxide layer and the silicon-containing oxide layer are dissolved when the tension-insulation coating is formed, and an adhesion improving effect is reduced. In addition, as another possibility, a possibility of the iron-based oxide layer being excessively formed is considered. It is speculated that, when the iron-based oxide layer is excessively formed, since the iron-based oxide (smudge) released from the surface is generated, a treatment solution used for forming the tension-insulation coating does not adhere to the surface of the steel sheet.

Based on the above findings, it became clear that it is important to form the iron-based oxide layer and the silicon-containing oxide layer in an appropriate state in order to realize excellent adhesion of the tension-insulation coating.

Figure 3A:
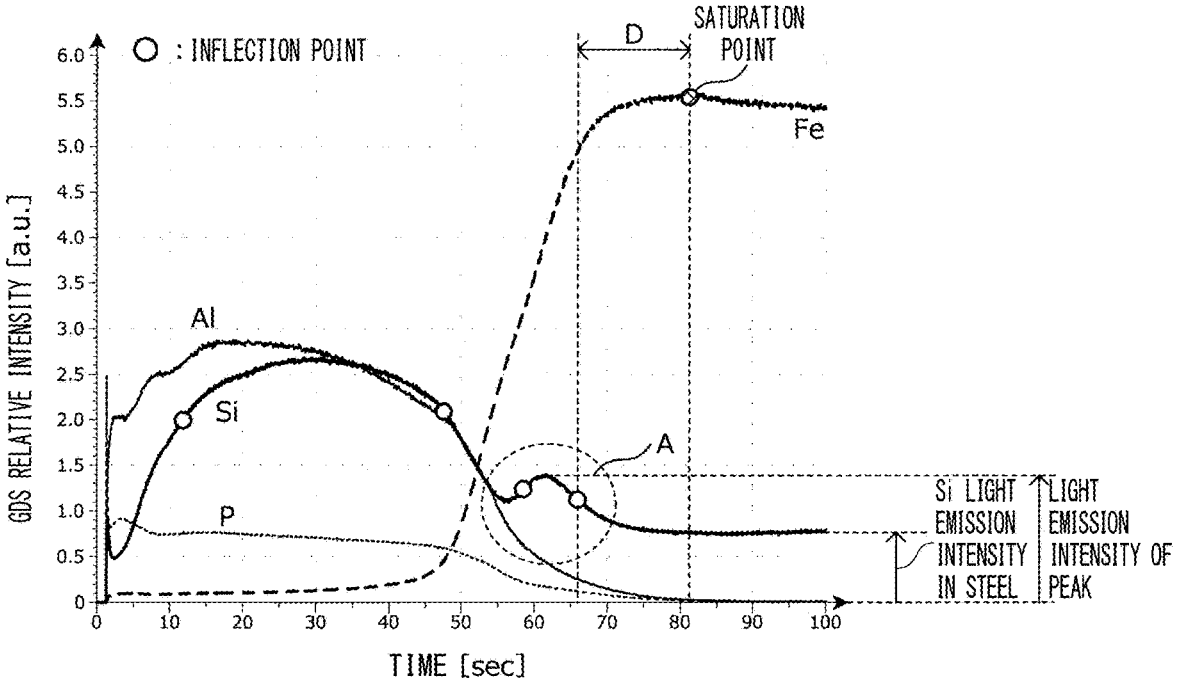
FIG. 3A is a graph diagram showing an example of analysis results of the grain-oriented electrical steel sheet according to the same embodiment obtained by a glow discharge optical emission spectrometry.
Figure 3B:
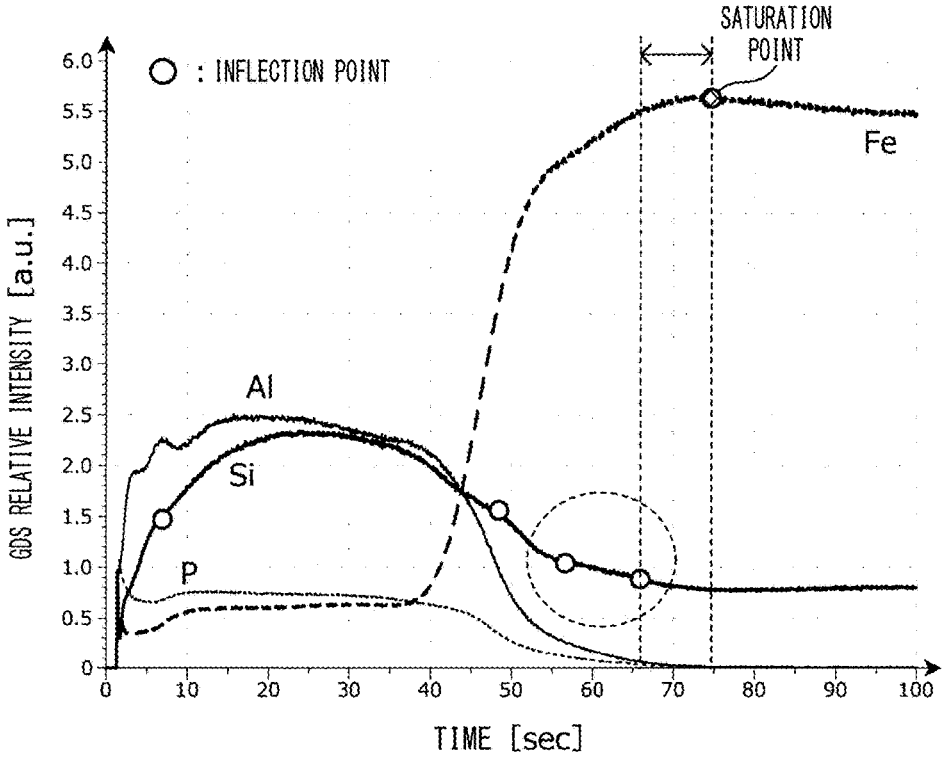
FIG. 3B is a graph diagram showing an example of analysis results of the grain-oriented electrical steel sheet having poor adhesion of a tension-insulation coating obtained by a glow discharge optical emission spectrometry.

Based on the above findings, it became clear that, when the grain-oriented electrical steel sheet with favorable adhesion is analyzed by glow discharge optical emission spectrometry (GDS), characteristic peak is observed in the obtained GDS chart. FIG. 3A shows an example of results obtained by analyzing the grain-oriented electrical steel sheet with favorable adhesion by GDS, and FIG. 3B shows an example of results obtained by analyzing the grain-oriented electrical steel sheet with poor adhesion by GDS. For each grain-oriented electrical steel sheet, a tension-insulation coating is formed using a treatment solution containing colloidal silica and aluminum phosphate. In FIG. 3A and FIG. 3B, the horizontal axis represents the elapsed time [seconds] from when the analysis started, and the vertical axis represents the GDS relative intensity [a.u.]. Since GDS is a method of analyzing the surface of a sample toward a deeper part in the thickness direction while sputtering, a longer elapsed time indicates that a deeper part of the sample is analyzed. In addition, in FIG. 3A and FIG. 3B, for elements other than Fe, the obtained results are enlarged three times, and displayed in the figures.

With reference to FIG. 3A and FIG. 3B, a light emission peak derived from Al and a light emission peak derived from Si are observed in an area in which the elapsed time is about 0 seconds to 50 seconds. In addition, it can be seen that the GDS relative intensity derived from P also slightly increases near 5 seconds and then gradually decreases, and there is a gently and broadly distributed light emission peak derived from P. Since these peaks contain Al, Si, and P, they are derived from the tension-insulation coating 13. In addition, it can be understood that, since the number of light emission peaks derived from Fe increases as the elapsed time is longer, the iron-based oxide layer is formed.

Focusing on the GDS analysis results of the grain-oriented electrical steel sheet with excellent adhesion shown in FIG. 3A, it can be understood that the light emission peak derived from Al and the light emission peak derived from P decrease monotonically, but the second light emission peak derived from Si is observed in the area A surrounded by the dashed line in FIG. 3A, and there are a total of four inflection points in the profile regarding the Si light emission intensity. These four inflection points are observed in all of the grain-oriented electrical steel sheets with favorable adhesion although the elapsed times at which the inflection points are present are different. Therefore, it can be understood that the second Si light emission peak present between the third inflection point and the fourth inflection point located on the side of the base steel sheet is derived from a silicon-containing oxide layer containing silica and fayalite ($Fe_2SiO_4$) as a main component.

In particular, focusing on the position of the inflection point (hereinafter referred to as an inflection point B in some cases) positioned closest to the base steel sheet side, it became clear that, in any of the grain-oriented electrical steel sheets with favorable adhesion, the position of the inflection point B is present within a range of 0.3 to 1.5 μm toward the surface of the grain-oriented electrical steel sheet (that is, the side of the tension-insulation coating) with respect to the point at which the Fe light emission peak intensity is a maximum (in FIG. 3A, the position at which the elapsed time is about 80 seconds; hereinafter, will be referred to as a saturation point in some case). The distance in the sheet thickness direction from the saturation point of the Fe light emission intensity to the inflection point (inflection point B) positioned closest to the base steel sheet side corresponds to the distance D in FIG. 3A, and is D=0.8 μm in FIG. 3A In addition, it became clear that, in any of the grain-oriented electrical steel sheets with favorable adhesion, the light emission intensity of the Si light emission peak (hereinafter referred to as a peak B in some cases) positioned closest to the base steel sheet side is 1.3 times or more and 2.0 times or less the Si light emission intensity in the base steel sheet (that is, the light emission intensity of a part in which sputtering proceeds to the part of the base steel sheet and the intensity of the light emission peak derived from Si becomes steady). In FIG. 3A, the Si light emission intensity of the peak B is 1.8 times the Si light emission intensity in the base steel sheet. On the other hand, it became clear that, when the position of the inflection point B is not present within a range of 0.3 to 1.5 μm with respect to the saturation point or when the Si light emission intensity of the peak B is less than 1.5 times or more than 3.5 times the Si light emission intensity in the base steel sheet, the tension-insulation coating has poor adhesion.

Here, the position of the inflection point in the profile of the Si light emission intensity described above can be determined by generating a profile obtained by second-order differentiating a Si light emission intensity profile by any known numerical calculation application and specifying the position at which the intensity becomes zero in the second derivative profile.

In this manner, it became clear that, when a part in which the Si element is segregated at a certain depth position of the grain-oriented electrical steel sheet is the silicon-containing oxide layer 17 in the present embodiment, and the Si element in the part (the area A in FIG. 3A) corresponding to the silicon-containing oxide layer 17 has a specific concentration (1.3 times or more and 2.0 times or less the Si light emission intensity in steel), favorable adhesion is exhibited. Since the Si element segregated part is derived from Si diffused from the base steel sheet, the Si element segregated part is present at a position close to the base steel sheet.

On the other hand, as shown in FIG. 3B, in the GDS analysis results of the grain-oriented electrical steel sheets with poor adhesion, although the second peak derived from Si as described above is slightly observed, the position (distance D in FIG. 3B) of the inflection point positioned closest to the base steel sheet side is 0.4 μm, which is outside the above range, and the Si light emission intensity is 1.2 times the Si light emission intensity in the steel, which is outside the above range. In addition, it became clear that, when other grain-oriented electrical steel sheets with poor adhesion are analyzed by GDS, the second peak derived from Si is not observed, and as a result, four inflection points are not present.

Here, since GDS is a method of analyzing an area with a diameter of about 5 mm while sputtering, it can be considered that, in the GDS analysis results as shown in FIG. 3A, an average behavior of each element is observed in an area having a diameter of about 5 mm in the sample. Therefore, it is considered that, in a coil in which the grain-oriented electrical steel sheet is wound, when the GDS analysis result of an optional area at a position an optional distance away from the head of the coil shows the behavior as shown in FIG. 3A, parts having the same distance from the head of the coil show the same GDS analysis results as shown in FIG. 3A. In addition, it can be considered that, if the GDS analysis results show the behavior as shown in FIG. 3A at both the head and the tail of the coil, the GDS analysis results show the behavior as shown in FIG. 3A in the entire coil.

As described above, in the grain-oriented electrical steel sheet 1 according to the present embodiment, when elemental analysis is performed from the surface of the grain-oriented electrical steel sheet 1 in the sheet thickness direction of the grain-oriented electrical steel sheet 1 by glow discharge optical emission spectrometry (GDS), the silicon-containing oxide layer 17 that satisfies all of the following conditions (a) to (c) is present.

(a) In a profile of a Si light emission intensity, there are four or more inflection points.

(b) In the sheet thickness direction, the inflection point of the Si light emission intensity present closest to the base steel sheet side is present within a range of 0.3 to 1.5 μm toward the side of the surface of the tension-insulation coating from the saturation point at which the Fe light emission intensity is a maximum.

(c) A peak of the Si light emission intensity present closest to the base steel sheet side has a light emission intensity that is 1.3 times or more and 2.0 times or less the Si light emission intensity in the base steel sheet.

In the above condition (a), the reason why the number of inflection points in the profile of the Si light emission intensity is four or more is as follows. When the grain-oriented electrical steel sheet is analyzed by GDS, depending on the state of the tension-insulation coating, shoulders (overlapping peaks) occur at the Si light emission peak derived from the tension-insulation coating, and in FIG. 3A, two or more light emission peaks that are visible as one peak may be observed. In addition, in the grain-oriented electrical steel sheet, in order to apply a stronger tension, the tension-insulation coating may be formed a plurality of time while changing the Si concentration of the treatment solution. In this case, at the left end of the GDS analysis results as shown in FIG. 3A (short elapsed time=side of surface layer of grain-oriented electrical steel sheet), a plurality of light emission peaks derived from the tension-insulation coating are observed. As a result, in the profile of the Si light emission intensity, four or more inflection points may be observed. However, when the number of inflection points of the Si light emission intensity is five or more, since the Si segregated part to be focused on is derived from Si diffused from the base steel sheet, the inflection point B present closest to the base steel sheet side may be focused among the plurality of observed inflection points.

In the above condition (b), the position of the inflection point B of the Si light emission intensity present closest to the base steel sheet side can be calculated using a time difference between the saturation point and the inflection point B and the sputtering speed in the GDS.

The silicon-containing oxide layer 17 is formed when a pickling treatment for forming the microstructure 21 on the surface of the base steel sheet 11 is performed using a surface treatment liquid and a heat treatment is then performed at a predetermined temperature.

The conditions for performing depth direction analysis by GDS from the surface of the grain-oriented electrical steel sheet are as follows. When depth direction analysis is performed by GDS under the following conditions, in the grain-oriented electrical steel sheet with excellent adhesion, the GDS analysis results as shown in FIG. 3A can be obtained. That is, in a high frequency mode of a general glow-discharge optical emission spectrometer (for example, GDA 750 commercially available from Rigaku Corporation), measurement is performed under output: 30 W, Ar pressure: 3 hPa, measurement area: 4 mmφ, measurement time: 100 seconds, and thus the GDS analysis results as shown in FIG. 3A can be obtained.

The thickness (thickness $d_3$ in FIG. 1) of the silicon-containing oxide layer 17 is 100 nm or less in many cases, and may be about 20 to 30 nm. Here, the thickness of the silicon-containing oxide layer 17 can be calculated from a sputtering speed in GDS and the elapsed time width in which the second peak derived from Si is observed as shown in the area A in FIG. 3A.

The main component of the silicon-containing oxide layer 17 can be determined by the X-ray crystal structure analysis method or XPS analysis.

<Regarding Thickness of Base Steel Sheet 11>

In the grain-oriented electrical steel sheet 1 according to the present embodiment, the thickness (thickness d in FIG. 1) of the base steel sheet 11 is not particularly limited, and can be, for example, 0.27 mm or less. Generally, in the grain-oriented electrical steel sheet, as the thickness of the steel sheet is thinner, the adhesion of the tension-insulation coating decreases in many cases. However, in the grain-oriented electrical steel sheet 1 according to the present embodiment, when the iron-based oxide layer 15 and the silicon-containing oxide layer 17 are provided, excellent adhesion of the tension-insulation coating 13 can be obtained even if the thickness d is 0.27 mm or less.

In the present embodiment, even if the thickness d of the base steel sheet 11 is as thin as 0.23 mm or less, excellent adhesion of the tension-insulation coating 13 can be obtained. In the grain-oriented electrical steel sheet 1 according to the present embodiment, the thickness d of the base steel sheet 11 is more preferably in a range of 0.17 to 0.23 mm. Here, in the grain-oriented electrical steel sheet 1 according to the present embodiment, the thickness d of the base steel sheet 11 is not limited to the above range.

The grain-oriented electrical steel sheet according to the present embodiment does not have an inorganic coating containing forsterite as a main component. The state in which "an inorganic coating containing forsterite as a main component is not formed" is determined by the following analysis.

In order to specify each layer in the cross-sectional structure, using energy dispersive X-ray spectroscopy (EDS) attached to a scanning electron microscope (SEM) or a transmission electron microscope (TEM), line analysis is performed in the sheet thickness direction, and quantitative analysis is performed on chemical components of each layer. The elements to be quantitatively analyzed are 6 elements: Fe, P, Si, O, Mg, and Al.

A layered area which is present at the deepest position in the sheet thickness direction, which is an area in which the Fe content is 80 atom % or more and the O content is less than 30 atom % excluding measurement noises, is determined as the base steel sheet.

Regarding the area excluding the base steel sheet determined above, an area in which the Fe content is less than 80 atom %, the P content is 5 atom % or more, and the O content is 30 atom % or more excluding measurement noises is determined as the tension-insulation coating.

An area excluding the base steel sheet and the tension-insulation coating determined above is determined as an intermediate layer composed of a silicon-containing oxide layer and an iron-based oxide layer. The intermediate layer may satisfy, as an overall average, an Fe content of less than 80 atom % on average, a P content of less than 5 atom % on average, a Si content of 20 atom % or more on average, and an O content of 30 atom % or more on average. In addition, in the present embodiment, since the intermediate layer is not a forsterite coating, the intermediate layer may satisfy a Mg content of less than 20 atom % on average. The Mg content of the intermediate layer is preferably 10 atom % or less, more preferably 5 atom % or less, and still more preferably 3 atom % or less.

As described above, when the grain-oriented electrical steel sheet according to the present embodiment includes the iron-based oxide layer 15 and the silicon-containing oxide layer 17 which are provided between the base steel sheet 11 and the tension-insulation coating 13, it is possible to further improve the adhesion of the tension-insulation coating 13, and it is possible to extremely reduce the high magnetic field iron loss, for example, at 1.7 T to 1.9 T.

Various magnetic characteristics of the grain-oriented electrical steel sheet according to the present embodiment such as a magnetic flux density and iron loss can be measured according to the Epstein's method defined in JIS C 2550 and the single sheet magnetic characteristic measurement method (Single Sheet Tester: SST) defined in JIS C 2556.

The grain-oriented electrical steel sheet according to the present embodiment has been described above in detail.

(Regarding Method for Manufacturing a Grain-Oriented Electrical Steel Sheet)

Figure 4:
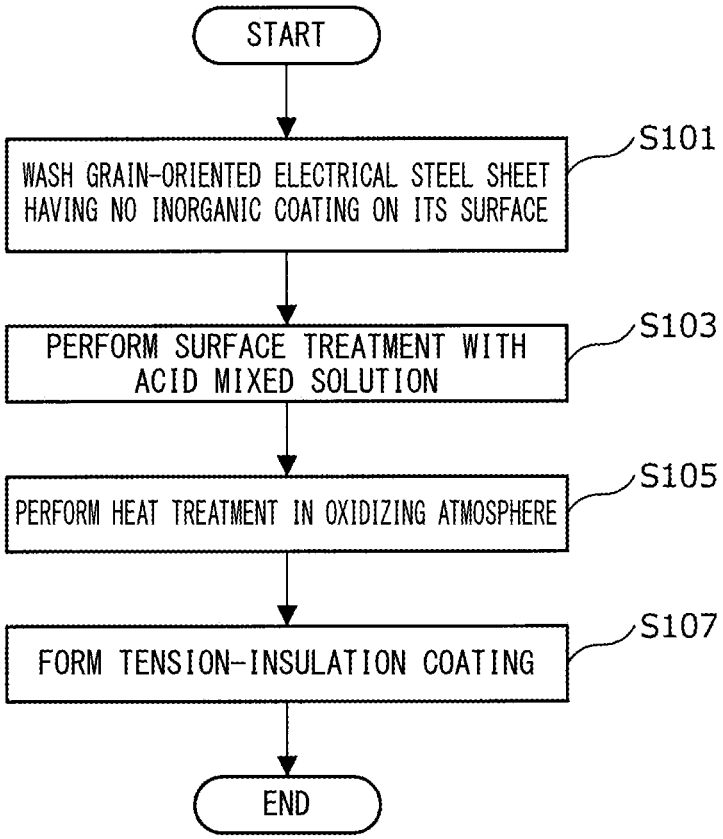
FIG. 4 is a flowchart showing an example of a flow of a method of producing a grain-oriented electrical steel sheet according to the same embodiment.

Subsequently, with reference to FIG. 4, a method for manufacturing a grain-oriented electrical steel sheet according to the present embodiment will be described in detail. FIG. 4 is a flowchart showing an example of a flow of a method of producing a grain-oriented electrical steel sheet according to the present embodiment.

In the method for manufacturing a grain-oriented electrical steel sheet according to the present embodiment, as described above, a grain-oriented electrical steel sheet having no inorganic coating containing forsterite as a main component on its surface (more specifically, a finally annealed grain-oriented electrical steel sheet that does not have an inorganic coating containing forsterite as a main component on its surface) is used as the base steel sheet 11.

A method for obtaining a grain-oriented electrical steel sheet having no inorganic coating is not particularly limited. For example, a method including a hot rolling process in which a steel piece containing, as chemical components, by mass %, 2.5 to 4.5% of Si, 0.05 to 1.00% of Mn, less than 0.05% of Al, less than 0.1% of C, less than 0.05% of N, less than 0.1% of S, less than 0.05% of Se and less than 0.01% of Bi with the remainder being Fe and impurities is hot-rolled, an optional annealing process, a cold rolling process in which one instance of cold rolling or two or more instances of cold rolling with intermediate annealing therebetween are performed, a decarburization annealing process, and a final annealing process may be exemplified.

Here, in order to prevent formation of an inorganic coating, for example, a method in which an annealing separator that does not form an inorganic coating is applied and final annealing is performed and a method in which final annealing is performed using a generally used annealing separator and the generated inorganic coating is then removed by a known method such as grinding or pickling may be exemplified.

Among the above methods, the method in which final annealing is performed using an annealing separator that does not form an inorganic coating is preferable because it is easy to control and the surface state of the steel sheet is also favorable. As such an annealing separator, for example, it is preferable to use an annealing separator incorporating bismuth chloride into a mixture of MgO and $Al_2O_3$ or an annealing separator incorporating a bismuth compound and a metallic chloride compound into a mixture of MgO and $Al_2O_3$.

Examples of bismuth chlorides include bismuth oxychloride (BiOCl) and bismuth trichloride ($BiCl_3$). Examples of bismuth compounds include bismuth oxide, bismuth hydroxide, bismuth sulfide, bismuth sulfate, bismuth phosphate, bismuth carbonate, bismuth nitrate, organic acid bismuth, and bismuth halide. Examples of metal chloride compounds include iron chloride, cobalt chloride, and nickel chloride. The amount of the bismuth chloride or the bismuth compound and the metallic chlorinated product is not particularly limited, but is preferably about 3 to 15 parts by mass with respect to 100 parts by mass of the mixture of MgO and $Al_2O_3$.

Generally, when a grain-oriented electrical steel sheet is produced, after final annealing, the excess adhered annealing separator is removed by cleaning, and flattening annealing is then performed.

On the other hand, as shown in FIG. 4, in a method for manufacturing a grain-oriented electrical steel sheet according to the present embodiment, using the finally annealed grain-oriented electrical steel sheet having no inorganic coating, an excess annealing separator is removed by cleaning (Step S101, washing process), and an acid with a specific concentration (surface treatment liquid) is then applied to the surface of the steel sheet to perform a surface treatment (Step S103, surface treatment process), a heating treatment is performed at a specific temperature in an oxidizing atmosphere (Step S105, heating treatment process), and the tension-insulation coating is formed with favorable adhesion under specific conditions (Step S107, tension-insulation coating forming process). Thereby, on the surface of the finally annealed grain-oriented electrical steel sheet having no inorganic coating, it is possible to form an intermediate layer mainly composed of the iron-based oxide layer and the silicon-containing oxide layer described above, and it is possible to improve the adhesion of the tension-insulation coating.

<Regarding Surface Treatment Process>

The surface treatment liquid used in the surface treatment process of Step S103 contains one or two or more of sulfuric acid, nitric acid, and phosphoric acid, and has a total acid concentration of 2 to 20 mass % and a liquid temperature of 70 to 90° C. When the surface of the steel sheet is etched using the surface treatment liquid, etch pits are formed on the surface of the steel sheet, and additionally it is possible to form an active surface state that cannot generally be obtained. The etch pits formed on the surface of the steel sheet are schematically shown as the microstructure 21 in FIG. 2.

When the liquid temperature of the surface treatment liquid is lower than 70° C., the solubility of the surface treatment liquid decreases, not only the possibility of a precipitate being formed can increase, but also effective etch pits cannot be obtained. On the other hand, when the liquid temperature of the surface treatment liquid is higher than 90° C., this is not preferable because the reactivity of the surface treatment liquid becomes too high, and the surface of the steel sheet is excessively etched during the surface treatment process.

The liquid temperature of the surface treatment liquid is preferably in a range of 75 to 87° C. and more preferably in a range of 80 to 85° C.

When the total acid concentration of the surface treatment liquid is less than 2 mass %, this is industrially disadvantageous because etch pits cannot be appropriately formed on the surface of the steel sheet and the treatment time becomes long. When the total acid concentration of the surface treatment liquid exceeds 20 mass %, this is not preferable because the surface of the steel sheet is excessively etched during the surface treatment process.

The total acid concentration of the surface treatment liquid is preferably in a range of 2 to 17 mass % and more and more preferably in a range of 2 to 10 mass %.

The treatment time for the surface treatment process is not particularly limited. The surface treatment process is performed by continuously immersing steel sheets in a treatment bath in which the surface treatment liquid is retained in many cases. When this method is used, the time for the steel sheet to pass through the treatment bath is the treatment time for the surface treatment process. When steel sheets are immersed in the treatment bath and caused to pass therethrough at a general sheet passing speed, it is possible to realize the active surface state described above.

<Regarding Heating Treatment Process>

In order to form the iron-based oxide layer and the silicon-containing oxide layer on the grain-oriented electrical steel sheet after the surface treatment process, heating is performed in an atmosphere having an oxygen concentration of 1 to 21 volume % and a dew point of −20 to 30° C., for 10 to 60 seconds so that the steel sheet temperature becomes 700 to 900° C. (heating treatment process).

When the oxygen concentration in the atmosphere is less than 1 volume %, it takes too much time for the iron-based oxide layer to be formed, and the productivity is lowered. On the other hand, when the oxygen concentration in the atmosphere exceeds 21 volume %, this is not preferable because the formed iron-based oxide layer tends to be non-uniform. The concentration of oxygen in the atmosphere is preferably in a range of 2 to 21 volume % and more preferably in a range of 15 to 21 volume %.

When the dew point in the atmosphere is lower than −20° C., it takes too much time for the iron-based oxide layer to be formed, and the productivity is lowered. On the other hand, when the dew point in the atmosphere is higher than 30° C., this is not preferable because the formed iron-based oxide layer tends to be non-uniform. The dew point in the atmosphere is preferably in a range of −10 to 25° C., and more preferably in a range of −10 to 20° C.

When the heating temperature of the steel sheet in the heating treatment process is lower than 700° C., this is not preferable because it is difficult to form the iron-based oxide layer and the silicon-containing oxide layer in an appropriate state even if the heating time is 60 seconds. On the other hand, when the heating temperature of the steel sheet is higher than 900° C., this is not preferable because the iron-based oxide layer tends to be non-uniform and the silicon-containing oxide layer in a desired state cannot be formed.

The heating temperature of the steel sheet in the heating treatment process is preferably in a range of 750 to 800° C.

When the heating time is shorter than 10 seconds, this is not preferable because the produced iron-based oxide layer and silicon-containing oxide layer tend to be non-uniform. On the other hand, when the heating time is longer than 60 seconds, this is not preferable because high cost is industrially required. The heating time is preferably in a range of 20 to 30 seconds.

When the heating treatment process is performed after the surface treatment process, the activated surface of the grain-oriented electrical steel sheet having no inorganic coating is oxidized, an iron-based oxide layer having a coefficient of thermal expansion that is between those of the metal and the insulation coating is formed, and a silicon-containing oxide layer is formed with Si diffused from the base steel sheet. Etch pits are formed on the surface of the grain-oriented electrical steel sheet, and an iron-based oxide layer having a preferable coefficient of thermal expansion and a silicon-containing oxide layer in a preferable segregation state are formed to alleviate strain, and thus further improvement of the adhesion of the tension-insulation coating can be realized, and an effect of improving a high magnetic field iron loss can be exhibited.

<Regarding Tension-Insulation Coating Forming Process>

In the method for manufacturing a grain-oriented electrical steel sheet according to the present embodiment, in the tension-insulation coating forming process, using the following treatment solution for forming a tension-insulation coating of the phosphate silica mixed system, the treatment solution is applied and dried under the following conditions. When a tension-insulation coating is formed on the surface of the steel sheet, it is possible to further improve the magnetic characteristics of the grain-oriented electrical steel sheet.

Before the treatment solution for forming a tension-insulation coating is applied, the surface of the steel sheet on which the tension-insulation coating is formed may be subjected to an optional pretreatment such as a degreasing treatment with an alkali or the like, or the surface may remain without such a pretreatment.

The tension-insulation coating formed on the surface of the steel sheet is not particularly limited as long as it is used as the tension-insulation coating of the phosphate silica mixed system of the grain-oriented electrical steel sheet, and it is possible to use a tension-insulation coating of a known phosphate silica mixed system. Examples of such a tension-insulation coating include a coating containing phosphate and colloidal silica as main components. As another example, a composite insulation coating which contains phosphate and colloidal silica as main components and in which fine organic resin particles are diffused may be exemplified.

In the method for manufacturing a grain-oriented electrical steel sheet according to the present embodiment, a treatment solution for forming a tension-insulation coating is applied to the surface of the grain-oriented electrical steel sheet after the heating treatment process, and within 1.0 to 20 seconds after the application, the grain-oriented electrical steel sheet after application is heated at an average heating rate of 20 to 100° C./s, and baked at a steel sheet temperature of 850 to 950° C. for 10 to 60 seconds.

In an actual operation, since it is often difficult to set the time until heating starts after the treatment solution for forming a tension-insulation coating is applied to shorter than 1.0 seconds, the time until heating starts is 1.0 seconds or longer after application. On the other hand, when the time until heating starts is longer than 20 seconds, the reaction between the surface of the grain-oriented electrical steel sheet subjected to the heat treatment process and the treatment solution for forming a tension-insulation coating has progressed too much, and the iron-based oxide layer and the silicon-containing oxide layer formed in the heat treatment process are highly likely to dissolve. Therefore, the time until heating starts after the treatment solution is applied is 1.0 seconds or longer and 20 seconds or shorter. Here, a shorter time until heating starts is better.

When the average heating rate is less than 20° C./s, the reaction between the surface of the grain-oriented electrical steel sheet subjected to the heat treatment process and the treatment solution for forming a tension-insulation coating has progressed too much, and the iron-based oxide layer and the silicon-containing oxide layer formed in the heat treatment process are highly likely to dissolve. On the other hand, when the average heating rate exceeds 100° C./s, this is not preferable because the desired steel sheet temperature during baking is highly likely to be overshot. Therefore, in the present embodiment, the average heating rate is in a range of 20 to 100° C./s. The average heating rate is preferably in a range of 25 to 50° C./s.

In the tension-insulation coating forming process, the treatment solution is baked at a steel sheet temperature of 850 to 950° C. for 10 to 60 seconds. When the steel sheet temperature is lower than 850° C., even if the retention time is 60 seconds, the formed tension-insulation coating cannot achieve desired characteristics. On the other hand, when the steel sheet temperature is higher than 950° C., even if the retention time is 10 seconds, the tension-insulation coating is excessively baked, and the formed tension-insulation coating cannot achieve desired characteristics. In addition, when the retention time is shorter than 10 seconds, the treatment solution for forming a tension-insulation coating cannot be sufficiently dried, and when the retention time is longer than 60 seconds, the formed tension-insulation coating cannot achieve desired characteristics. The steel sheet temperature is preferably in a range of 870 to 900° C., and the retention time is preferably in a range of 25 to 45 seconds.

Thereby, the tension-insulation coating with a thickness of 1 to 3 μm is formed on the surface of the iron-based oxide layer.

The time between the surface treatment process and the heat treatment process is preferably as short as possible, and for example, preferably within several minutes.

Following the tension-insulation coating forming process, flattening annealing for shape correction may be performed.

When flattening annealing is performed on the steel sheet, it is possible to further reduce the iron loss.

The method of producing a grain-oriented electrical steel sheet according to the present embodiment has been described above in detail.

EXAMPLES

A grain-oriented electrical steel sheet and a method of producing a grain-oriented electrical steel sheet according to the present invention will be described below in detail with reference to examples and comparative examples. Here, the following examples are only examples of the grain-oriented electrical steel sheet and the method of producing a grain-oriented electrical steel sheet according to the present invention. The grain-oriented electrical steel sheet and the method of producing a grain-oriented electrical steel sheet according to the present invention are not limited to the following examples.

Experimental Example

A steel piece (silicon steel slab) containing, by mass %, C: 0.08%, Si: 3.24%, Mn: 0.08%, Al: 0.028%, N: 0.008%, S: 0.03%, Se: 0.01%, and Bi: 0.004% with the remainder being Fe and impurities was cast, and the obtained steel piece was heated and then hot-rolled to obtain a hot band with a sheet thickness of 2.2 mm. After annealing at a steel sheet temperature of 1,100° C. for 60 seconds, cold rolling was performed until the sheet thickness became 0.22 mm, and decarburization annealing was performed at a steel sheet temperature of 830° C. Then, an annealing separator containing MgO and $Al_2O_3$ as main components and 10 mass % of BiOCl which is bismuth chloride was applied and dried, and final annealing was performed at a steel sheet temperature of 1,200° C. for 20 hours (the final annealing under such conditions is also called "purification annealing"). When the excess annealing separator was removed by cleaning with water after final annealing, no inorganic coating was formed on the surface of the steel sheet. In addition, in the results of such final annealing, the Al content was 0% or more and less than 0.05%, the C content was 0% or more and less than 0.1%, the N content was 0% or more and less than 0.05%, the S content was 0% or more and less than 0.1%, the Se content was 0% or more and less than 0.05%, and the Bi content was 0% or more and less than 0.01%.

An aqueous solution containing aluminum phosphate and colloidal silica as main components shown in Table 1 was prepared. Here, for various phosphates shown in Table 1, a commercially available general special grade reagent was used, and for colloidal silica, a commercially available general special grade reagent was used. Here, the average particle sizes of colloidal silica shown in Table 1 are all catalog values.

After the surface treatment process and the heat treatment process were performed on the steel sheet after final annealing under conditions shown in Table 2-1, an aqueous solution containing aluminum phosphate and colloidal silica as main components shown in Table 1 was applied and baked, and a tension-insulation coating with a thickness of 2.5 μm was formed on the surface of the steel sheet.

For the grain-oriented electrical steel sheets produced in this manner, using XPS (PHI 5600 commercially available from ULVAC-PHI, Inc.), the thickness $d_2$ of the iron-based oxide layer was measured according to the above method, and the main component of the iron-based oxide layer was determined by the X-ray crystal structure analysis method.

In addition, the obtained grain-oriented electrical steel sheet was analyzed by a GDS (glow-discharge optical emission spectrometer GDA 750 commercially available from Rigaku Corporation) according to the following analysis conditions.

XPS Measurement Conditions

X-ray source: MgKα

Analysis area: about 800 μmφ

Depth direction analysis (sputtering yield: 2 nm/min in terms of $SiO_2$)

Measurement element: C, O, Al, Si, Fe

Measurement surface: the outmost surface, after sputtering for 0.1, 0.5, 1, 2, 5, 10, 20, 30, 40, 50, 60, 70, 80, 90, and 100 minutes GDS Measurement Conditions High frequency mode Output: 30 W Ar pressure: 3 hPa Measurement area: 4 mmφ

Measurement time: 100 seconds

Measurement element: O, Al, Si, P, Fe

In addition, the high magnetic field iron loss (the iron loss at a frequency of 50 Hz when the maximum magnetic flux density was 1.7 T or 1.9 T) after a laser beam was emitted and a magnetic domain subdivision treatment was performed was measured by the single sheet magnetic characteristic measurement method (Single Sheet Tester: SST) according to JIS C 2556. In addition, according to the following evaluation method, the adhesion and the coating tension of the tension-insulation coating were evaluated. The obtained results are summarized in Table 2-2.

The number of inflection points of the profile of the Si light emission intensity in the GDS analysis results was counted based on the second derivative profile obtained by second-order differentiating the Si light emission intensity profile obtained by a commercially available numerical calculation application. In addition, in the following Table 2-2, the column of "distance from the saturation point" in "GDS·Si light emission intensity" shows the distance between the position of the inflection point present closest to the base steel sheet side and the saturation point at which the Fe light emission intensity was a maximum.

<Evaluation of Adhesion of Tension-Insulation Coating>

The adhesion of the tension-insulation coating was evaluated as follows. First, a sample with a width of 30 mm and a length of 300 mm was collected from each grain-oriented electrical steel sheet, and subjected to strain-removing annealing at 800° C. in a nitrogen flow for 2 hours, a bending adhesion test was then performed using a 10 mmφ cylinder, and the adhesion was evaluated according to the degree of peeling of the tension-insulation coating. Evaluation criteria were as follows, and the score A and the score B were satisfactory.

Score A: no peeling off

B: almost no peeling off

C: several mm of peeling off was observed

D: ⅓ to ½ of the surface was observed to have peeled off

E: the entire surface peeled off

<Evaluation of Coating Tension of Tension-Insulation Coating>

In addition, the coating tension of the tension-insulation coating was calculated by back calculation from the bending status when one side of the tension-insulation coating was peeled off. That is, the coating tension a was calculated using the following Formula (1).

$$\sigma \approx \{E/(1-\mu)\} \times (T^2/3t) \times (2H/L^2) \quad \text{Formula (1)}$$

Here, in Formula (1),

σ: coating tension [Pa]

E: Young's modulus [Pa]

μ: Poisson's ratio [−]

T: thickness [m] of sample t: thickness [m] of steel sheet

H: bending [m] of sample

L: length [m] of sample.

Then, the obtained coating tension was evaluated according to the following evaluation criteria. Evaluation criteria were as follows, and the score A to score C were satisfactory.

Score A: 8 MPa or more

B: 7 MPa or more and less than 8 MPa

C: 6 MPa or more and less than 7 MPa

D: 5 MPa or more and less than 6 MPa

E: less than 5 MPa

TABLE 1

| No. | Phosphate | Solid content concentration (mass %) | Colloidal silica | Solid content concentration (mass %) |
|---|---|---|---|---|
| 1 | Aluminum phosphate | 65 | Average particle size 15 nm, alkaline type | 35 |

TABLE 1-continued

| No. | Phosphate | Solid content concentration (mass %) | Colloidal silica | Solid content concentration (mass %) |
|---|---|---|---|---|
| 2 | Aluminum phosphate + magnesium phosphate | 60 | Average particle size 8 nm, aluminum coated type | 40 |
| 3 | Aluminum phosphate + zinc phosphate | 70 | Average particle size 30 nm, alkaline type | 30 |
| 4 | Aluminum phosphate | 58 | Average particle size 8 nm, alkaline type | 42 |
| 5 | Manganese phosphate | 34 | Average particle size 15 nm, acid type | 66 |
| 6 | Cobalt phosphate | 72 | Average particle size 15 nm, alkaline type | 28 |
| 7 | Aluminum phosphate + zinc phosphate + iron phosphate | 72 | Average particle size 15 nm, alkaline type | 28 |

TABLE 2-1

| | Surface treatment process | | | Heating treatment process | | | | Tension-insulation coating forming process | | | | |
|---|---|---|---|---|---|---|---|---|---|---|---|---|
| No. | Acid | Liquid temperature (° C.) | Treatment time (seconds) | Atmosphere (volume %) | Dew point (° C.) | Steel sheet temperature (° C.) | Treatment time (seconds) | Treatment solution | Time before heating (seconds) | Heating rate (° C./s) | Steel sheet temperature (° C.) | Retention time (seconds) |
| 1 | 10% sulfuric acid | 80 | 10 | 20% $O_2$ | 28 | 800 | 10 | 1 | 4 | 50 | 900 | 30 |
| 2 | 5% sulfuric acid | 80 | 12 | 20% $O_2$ | −18 | 800 | 20 | 2 | 8 | 50 | 900 | 30 |
| 3 | 5% sulfuric acid | 80 | 12 | 1% $O_2$ | 28 | 850 | 10 | 3 | 8 | 25 | 860 | 60 |
| 4 | 7% nitric acid | 70 | 20 | 20% $O_2$ | 20 | 800 | 10 | 4 | 16 | 85 | 950 | 12 |
| 5 | 15% phosphoric acid | 85 | 14 | 20% $O_2$ | 5 | 800 | 10 | 5 | 16 | 50 | 900 | 20 |
| 6 | 5% sulfuric acid | 80 | 12 | 20% $O_2$ | −18 | 850 | 10 | 6 | 4 | 50 | 900 | 20 |
| 7 | 5% sulfuric acid | 80 | 12 | 20% $O_2$ | −18 | 850 | 10 | 7 | 4 | 50 | 900 | 20 |
| 8 | 25% sulfuric acid | 60 | 10 | 20% $O_2$ | 5 | 850 | 10 | 1 | 4 | 25 | 830 | 55 |
| 9 | 1% sulfuric acid | 80 | 60 | 20% $O_2$ | 0 | 800 | 10 | 1 | 4 | 50 | 900 | 20 |
| 10 | 10% sulfuric acid | 60 | 10 | 20% $O_2$ | 0 | 800 | 30 | 2 | 8 | 50 | 900 | 20 |
| 11 | 5% sulfuric acid | 95 | 10 | 20% $O_2$ | 0 | 800 | 10 | 2 | 8 | 50 | 900 | 20 |
| 12 | 10% sulfuric acid | 75 | 10 | 20% $O_2$ | 5 | 600 | 30 | 3 | 8 | 50 | 900 | 20 |
| 13 | 15% phosphoric acid | 80 | 14 | 20% $O_2$ | 0 | 1,000 | 10 | 3 | 4 | 50 | 900 | 20 |
| 14 | 10% sulfuric acid | 80 | 10 | 3% $O_2$ | 25 | 800 | 4 | 1 | 8 | 50 | 900 | 20 |

TABLE 2-1-continued

| | Surface treatment process | | | Heating treatment process | | | | Tension-insulation coating forming process | | | | |
|---|---|---|---|---|---|---|---|---|---|---|---|---|
| No. | Acid | Liquid temperature (° C.) | Treatment time (seconds) | Atmosphere (volume %) | Dew point (° C.) | Steel sheet temperature (° C.) | Treatment time (seconds) | Treatment solution | Time before heating (seconds) | Heating rate (° C./s) | Steel sheet temperature (° C.) | Retention time (seconds) |
| 15 | 10% sulfuric acid | 80 | 10 | 20% $O_2$ | −15 | 800 | 80 | 1 | 4 | 50 | 900 | 20 |
| 16 | 10% sulfuric acid | 80 | 10 | 20% $O_2$ | 25 | 750 | 10 | 2 | 0.5 | 50 | 900 | 20 |
| 17 | 10% sulfuric acid | 80 | 10 | 20% $O_2$ | 5 | 880 | 30 | 2 | 30 | 50 | 900 | 20 |
| 18 | 10% sulfuric acid | 80 | 10 | 20% $O_2$ | 25 | 800 | 10 | 3 | 4 | 13 | 830 | 60 |
| 19 | 10% sulfuric acid | 80 | 10 | 20% $O_2$ | 5 | 800 | 30 | 3 | 4 | 160 | 950 | 12 |
| 20 | 10% sulfuric acid | 80 | 15 | 20% $O_2$ | 25 | 800 | 10 | 1 | 8 | 50 | 800 | 60 |
| 21 | 10% sulfuric acid | 80 | 12 | 20% $O_2$ | 5 | 800 | 30 | 2 | 8 | 85 | 980 | 12 |
| 22 | 10% sulfuric acid | 80 | 12 | 20% $O_2$ | 25 | 800 | 10 | 3 | 8 | 85 | 950 | 6 |
| 23 | 10% sulfuric acid | 80 | 12 | 20% $O_2$ | 5 | 800 | 30 | 4 | 8 | 25 | 830 | 90 |
| 24 | 10% sulfuric acid | 80 | 12 | No heat treatment | | | | 4 | 4 | 160 | 830 | 6 |

TABLE 2-2

| | Iron-based oxide layer Thickness | GDS · Si light emission intensity | | | | | High magnetic field iron loss (W/kg) | | |
|---|---|---|---|---|---|---|---|---|---|
| No. | (nm) | Number of inflection points | Distance from saturation point (μm) | Si ratio in steel | Adhesion | Coating tension | W17/50 | W19/50 | Note |
| 1 | 240 | 4 | 1.5 | 1.4 | A | A | 0.64 | 1.01 | Example |
| 2 | 140 | 4 | 1.2 | 1.8 | A | A | 0.62 | 0.93 | Example |
| 3 | 140 | 4 | 0.6 | 1.8 | B | C | 0.68 | 1.03 | Example |
| 4 | 340 | 4 | 1.0 | 1.7 | B | A | 0.65 | 0.97 | Example |
| 5 | 260 | 4 | 1.0 | 1.6 | A | A | 0.61 | 0.89 | Example |
| 6 | 120 | 4 | 0.7 | 1.8 | A | A | 0.61 | 0.87 | Example |
| 7 | 120 | 4 | 0.9 | 1.6 | B | A | 0.66 | 0.99 | Example |
| 8 | 220 | 4 | 1.5 | 2.3 | B | B | 0.71 | 1.21 | Comparative example |
| 9 | 40 | 3 | — | — | D | A | 0.68 | 1.18 | Comparative example |
| 10 | 420 | 4 | 0.2 | 1.2 | D | B | 0.67 | 1.08 | Comparative example |
| 11 | 80 | 4 | 0.4 | 1.2 | D | A | 0.65 | 1.10 | Comparative example |
| 12 | 60 | 3 | — | — | E | B | 0.69 | 1.17 | Comparative example |
| 13 | 560 | 4 | 1.5 | 2.1 | C | A | 0.73 | 1.21 | Comparative example |
| 14 | 80 | 4 | 0.3 | 0.8 | E | A | 0.71 | 1.15 | Comparative example |
| 15 | 460 | 4 | 2.1 | 3.3 | B | B | 0.70 | 1.18 | Comparative example |
| 16 | 100 | 3 | — | — | C | B | 0.66 | 1.14 | Comparative example |

TABLE 2-2-continued

| No. | Iron-based oxide layer Thickness (nm) | GDS · Si light emission intensity: Number of inflection points | Distance from saturation point (μm) | Si ratio in steel | Adhesion | Coating tension | High magnetic field iron loss (W/kg): W17/50 | W19/50 | Note |
|---|---|---|---|---|---|---|---|---|---|
| 17 | 300 | 4 | 0.4 | 0.4 | D | A | 0.69 | 1.13 | Comparative example |
| 18 | 140 | 4 | 0.3 | 0.8 | D | B | 0.69 | 1.08 | Comparative example |
| 19 | 240 | 4 | 0.4 | 0.5 | B | D | 0.66 | 1.08 | Comparative example |
| 20 | 140 | 4 | 0.5 | 0.7 | B | E | 0.71 | 1.17 | Comparative example |
| 21 | 220 | 4 | 1.8 | 1.9 | C | B | 0.72 | 1.17 | Comparative example |
| 22 | 160 | 4 | 2.3 | 1.5 | C | D | 0.69 | 1.09 | Comparative example |
| 23 | 240 | 4 | 2.4 | 2.1 | B | E | 0.68 | 1.09 | Comparative example |
| 24 | 160 | 4 | 0.6 | 0.9 | D | D | 0.70 | 1.09 | Comparative example |

Based on the results of analysis by the X-ray crystal structure analysis method, in the samples corresponding to the examples of the present invention, the iron-based oxide layer contained magnetite, hematite, and fayalite as main components, and the silicon-containing oxide layer contained silica and fayalite as main components. On the other hand, in comparative examples outside the scope of the present invention, the iron-based oxide layer containing magnetite, hematite, and fayalite as main components was formed, but the silicon-containing oxide layer having a predetermined number of inflection points and distance from the saturation point and exhibiting a predetermined Si light emission intensity was not formed.

As can be clearly seen in Table 2-2, it can be understood that the samples corresponding to the examples of the present invention had very excellent adhesion and the high magnetic field iron loss was improved. On the other hand, it can be understood that the samples corresponding to the comparative examples of the present invention were inferior in at least either the adhesion or the high magnetic field iron loss.

While preferable embodiments of the present invention have been described above in detail with reference to the appended drawings, the present invention is not limited to these examples. It can be clearly understood that those skilled in the art can implement various alternations or modifications within the technical ideas described in the scope of claims and of course these also belong to the technical scope of the present invention.

BRIEF DESCRIPTION OF THE REFERENCE SYMBOLS

1 Grain-oriented electrical steel sheet

11 Base steel sheet

13 Tension-insulation coating

15 Iron-based oxide layer

17 Silicon-containing oxide layer

21 Microstructure (etch pit)

The invention claimed is:

1. A grain-oriented electrical steel sheet which does not have an inorganic coating containing forsterite as a main component, comprising:

a base steel sheet;

a silicon-containing oxide layer provided on the base steel sheet;

an iron-based oxide layer provided on the silicon-containing oxide layer; and a tension-insulation coating provided on the iron-based oxide layer, having a thickness of 1 to 3 μm, and containing phosphate and colloidal silica as main components;

wherein the base steel sheet contains, as chemical components, in terms of mass %, 2.5 to 4.5% of Si, 0.05 to 1.00% of Mn, 0% or more and less than 0.05% of Al, 0% or more and less than 0.1% of C, 0% or more and less than 0.05% of N, 0% or more and less than 0.1% of S, 0% or more and less than 0.05% of Se and 0% or more and less than 0.01% of Bi, and the remainder: Fe and impurities, wherein, when elemental analysis is performed from a surface of the tension-insulation coating in a sheet thickness direction by glow discharge optical emission spectrometry, (a) in a profile of a Si light emission intensity, there are four or more inflection points;

(b) in the sheet thickness direction, the inflection point of the Si light emission intensity present closest to the base steel sheet side is present within a range of 0.3 to 1.5 μm toward the side of the surface of the tension-insulation coating from a saturation point at which an Fe light emission intensity is a maximum, and (c) a peak of the Si light emission intensity present closest to the base steel sheet side has a light emission intensity that is 1.3 times or more and 2.0 times or less the Si light emission intensity in the base steel sheet.

2. The grain-oriented electrical steel sheet according to claim 1, wherein the silicon-containing oxide layer contains silica and fayalite as main components, and wherein the tension-insulation coating contains 25 to 45 mass % of colloidal silica, with a remainder that contains one or more of aluminum phosphate, magnesium phosphate, zinc phosphate, manganese phosphate, cobalt phosphate, and iron phosphate as main components.

3. The grain-oriented electrical steel sheet according to claim 2, wherein the iron-based oxide layer contains magnetite, hematite and fayalite as main components.

4. The grain-oriented electrical steel sheet according to claim 2, wherein a thickness of the base steel sheet is 0.27 mm or less.

5. The grain-oriented electrical steel sheet according to claim 1, wherein the iron-based oxide layer contains magnetite, hematite and fayalite as main components.

6. The grain-oriented electrical steel sheet according to claim 5, wherein a thickness of the base steel sheet is 0.27 mm or less.

7. The grain-oriented electrical steel sheet according to claim 1, wherein a thickness of the base steel sheet is 0.27 mm or less.

8. A method for manufacturing the grain-oriented electrical steel sheet of claim 1, which includes a base steel sheet and a tension-insulation coating, comprising:

a washing process of cleaning a surface of the grain-oriented electrical steel sheet;

a surface treatment process of treating the surface of the grain-oriented electrical steel sheet which has been subjected to the washing process using a surface treatment liquid which contains one or more of sulfuric acid, phosphoric acid and nitric acid and having a total acid concentration of 2 to 20% and a liquid temperature of 70 to 90° C.;

a heating treatment process of heating the grain-oriented electrical steel sheet which has been subjected to the surface treatment process at a temperature of 700 to 900° C. for 10 to 60 seconds in an atmosphere having an oxygen concentration of 1 to 21 volume % and a dew point of −20 to 30° C.; and a tension-insulation coating forming process of forming a tension-insulation coating which has a thickness of 1 to 3 μm by applying a treatment solution for forming a tension-insulation coating containing phosphate and colloidal silica as main components to the surface of the grain-oriented electrical steel sheet after the heating treatment process, and heating is performed at an average heating rate of 20 to 100° C./s within 1.0 to 20 seconds after the application, and baking is performed at a temperature of 850 to 950° C. for 10 to 60 seconds.

9. The method for manufacturing a grain-oriented electrical steel sheet according to claim 8, further comprising:

before the washing process, a hot rolling process of subjecting a steel piece which contains, as chemical components, in terms of mass %, 2.5 to 4.5% of Si, 0.05 to 1.00% of Mn, less than 0.05% of Al, less than 0.1% of C, less than 0.05% of N, less than 0.1% of S, less than 0.05% of Se and less than 0.01% of Bi with the remainder comprising Fe and impurities to hot rolling;

an optional annealing process;

a cold rolling process of performing one cold rolling or two or more cold rollings having intermediate annealing performed between the cold rollings;

a decarburization annealing process; and a final annealing process of applying an annealing separator obtained by incorporating bismuth chloride into a mixture of MgO and $Al_2O_3$ or an annealing separator obtained by incorporating a bismuth compound and a metallic chloride compound into a mixture of MgO and $Al_2O_3$, drying the annealing separator, and then performing final annealing.

* * * * *